US011583011B2

(12) United States Patent
Mazzarolo et al.

(10) Patent No.: US 11,583,011 B2
(45) **Date of Patent: *Feb. 21, 2023**

(54) GARMENT PROVIDED WITH AN INFLATABLE PROTECTIVE DEVICE

(71) Applicant: Alpinestars Research S.p.A., Maser (IT)

(72) Inventors: Giovanni Mazzarolo, Coste di Maser (IT); Marco Signorelli, Albignasego (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 0 days.

This patent is subject to a terminal disclaimer.

(21) Appl. No.: 17/175,337

(22) Filed: Feb. 12, 2021

(65) Prior Publication Data

US 2021/0161221 A1 Jun. 3, 2021

Related U.S. Application Data

(63) Continuation of application No. 16/314,140, filed as application No. PCT/EP2017/066353 on Jun. 30, 2017, now Pat. No. 10,925,331.

(30) Foreign Application Priority Data

Jul. 1, 2016 (IT) ..... 102016000068775

(51) Int. Cl.
*A41D 13/018* (2006.01)
*A41D 1/00* (2018.01)

(52) U.S. Cl.
CPC ..... *A41D 13/018* (2013.01); *A41D 1/002* (2013.01); *A41D 2600/102* (2013.01)

(58) Field of Classification Search
CPC ..... A41D 13/018; A41D 2600/102; A41D 1/002; A41D 13/0512; A41D 13/0531;
(Continued)

(56) References Cited

U.S. PATENT DOCUMENTS 6,561,814 B2 5/2003 Tilbury et al.
7,329,230 B2 * 2/2008 Mazzarolo ..... A41D 13/0531 128/846

(Continued)

FOREIGN PATENT DOCUMENTS

CN 1383361 A 12/2002
CN 103874470 A 6/2014

(Continued)

OTHER PUBLICATIONS

PCT International Search Report and Written Opinion dated Aug. 11, 2017 for Intl. App. No. PCT/EP2017/066353, 13 pgs.

(Continued)

*Primary Examiner* — Robert H Muromoto, Jr.
(74) *Attorney, Agent, or Firm* — Fredrikson & Byron, P.A.

(57) ABSTRACT

A garment including an inflatable protective device that can include at least one inflatable bag suitable for moving between a rest condition, wherein it is deflated, and an operating condition, wherein it is inflated;

an inflator unit designed for inflating the at least one inflatable bag;

sensors designed for monitoring the user's body for shocks or unexpected movements; and a control unit designed for processing the data provided by the sensors and for activating the inflator unit if, on the basis of the data received by the sensors, a danger situation is identified.

(Continued)

The garment can further include a display unit which has an alphanumeric and/or graphical visual display for providing the user with messages and/or symbols about the internal status of the inflatable protective device.

19 Claims, 8 Drawing Sheets

(58) Field of Classification Search
CPC ..... A41D 13/0015; A41D 2600/104; A41D 13/0518; A41D 13/00; G08B 21/0446; G08B 21/043; G08B 21/0492; G08B 25/016; G08B 29/185; B60R 2021/0104; B60R 2021/01286; B60R 21/013; B60R 2021/01322; B60R 2021/01327; A61B 2562/0219; A61B 5/1117; A61B 5/0002; A61B 5/11; A61B 5/6804; A61B 5/746; G06F 1/163; G06F 1/1652; G06F 1/1684
See application file for complete search history.

(56) References Cited

U.S. PATENT DOCUMENTS 7,460,886 B2 * 12/2008 Mazzarolo ..... A41D 13/018 2/69
7,921,472 B2 * 4/2011 Mazzarolo ..... A41D 13/018 2/108
8,840,548 B2 * 9/2014 Mazzarolo ..... A61B 5/02 2/456
8,938,820 B2 * 1/2015 Mazzarolo ..... A41D 13/0512 2/468
9,332,794 B2 * 5/2016 Mazzarolo ..... A41D 13/0512
9,526,278 B2 * 12/2016 Briggs ..... A41D 13/018
9,773,397 B2 * 9/2017 Ten Kate ..... G08B 21/043
10,300,975 B2 * 5/2019 Mazzarolo ..... A41D 13/018
10,584,980 B2 * 3/2020 Ballantyne ..... G01D 5/145
10,602,784 B2 * 3/2020 Mazzarolo ..... A41D 13/018
2004/0111790 A1 * 6/2004 Dainese ..... A41D 13/018 2/456
2006/0155182 A1 * 7/2006 Mazzarolo ..... A61B 5/11 600/388
2007/0147272 A1 * 6/2007 Mazzarolo ..... A41D 13/018 370/280
2009/0055053 A1 * 2/2009 Carmeli ..... A41D 13/018 701/45
2012/0073035 A1 * 3/2012 Mazzarolo ..... A41D 13/0512 2/461
2012/0318781 A1 12/2012 Lavin, Jr.
2015/0128334 A1 * 5/2015 Mazzarolo ..... A41D 13/0512 2/456
2015/0173433 A1 * 6/2015 Mazzarolo ..... A41D 13/018 2/461
2015/0227164 A1 * 8/2015 Laycock ..... G06F 1/1652 345/82
2016/0174626 A1 * 6/2016 Mazzarolo ..... G08B 29/185 2/455
2017/0202279 A1 * 7/2017 Mazzarolo ..... A41D 1/002
2017/0314963 A1 * 11/2017 Ballantyne ..... G01D 5/14
2019/0223525 A1 * 7/2019 Mazzarolo ..... A41D 13/018

FOREIGN PATENT DOCUMENTS

CN 205214265 U 5/2016
EP 1315427 A1 6/2003
KR 101040673 B1 6/2011
WO 0220310 A2 3/2002
WO 2012104633 A2 8/2012
WO 2016012359 A1 1/2016

OTHER PUBLICATIONS

Chinese Patent Application No. 201780050632.0, English translation of second Office Action dated Oct. 28, 2020, 9 pgs.

* cited by examiner

GARMENT PROVIDED WITH AN INFLATABLE PROTECTIVE DEVICE

RELATED APPLICATIONS

This application is a continuation of application Ser. No. 16/314,140, filed Dec. 28, 2018, which is a 35 U.S.C. 371 national stage filing from International Application No. PCT/EP2017/066353, filed Jun. 30, 2017, which claims priority to Italian Application No. 102016000068775, filed Jul. 1, 2016, the teachings of which are incorporated herein by reference.

DESCRIPTION

The present invention relates to a garment provided with an inflatable protective device. In particular, the present invention refers, even if in a non-exclusive way, to a garment suitable for being worn by a motorcyclist.

It is well known that recently the protection offered to the motorcyclists in case of an accident or a fall has been improved thanks to the provision of protective garments provided with inflatable protective devices.

These inflatable protective devices comprise one or more inflatable bags arranged in the area of the body more prone to injuries in case of accident, for example, back, neck, chest, hip, etc.

The inflation of the inflatable bags is managed by a control unit which receives data from external sensors positioned for example on the shoulders, inside a back protector and on the hip area.

The sensors monitor the user's body for shocks or unexpected movements. In the event the user's body is subject to a sudden movement or deceleration, the control unit sends an activation signal to an inflator unit, provided in the garment and connected to the inflatable bags, so as to inflate the inflatable bags.

It is also known that the garments with inflatable protective devices might be provided with signal lights (for example LEDs), designed for indicating the status of the inflatable protective device, namely if the device is functioning and is able to be activated in case of accident.

Preferably these lights are on a little panel which is applied on one of the sleeves of the garment, so as to be easily seen by the user.

A well-known type of panel used in conjunction with garment provided with an inflatable protective device comprises only three colored LEDs: a green LED, an orange LED and a red LED.

Generally, a solid green LED indicates that the inflatable protective device is functioning and will deploy in case of an accident. A solid red LED or a flashing green LED indicates that the system will not deploy in a crash. A flashing orange LED indicates that the battery of the control unit needs to be charged.

However, even if such a type of panel is greatly appreciated, the user by checking the LEDs only knows if the inflatable protective device is correctly functioning or in alternatively if the protective device has a problem. The battery level may also be communicated to the user using a combination of LED flashing indications, but this is complicated for the user to interpret.

Nevertheless, in case the system has a problem, from the LED lights the user is not able to recognize what and where the problem is. At the same time, the user is not able to know how to fix, if it is possible, the issue.

As a matter of fact, a problem signaled by the LED display might be due to a sensor problem, to a low charge of the battery or to a not correct wearing of the garment.

Even if, in case of a problem, the LEDs of the display can be programmed for blinking a number of times corresponding to the code of the error that the system is experiencing, the information so provided is not easy to be managed by the user.

As a matter of fact, for obtaining additional information about the problem is occurring, the user should memorize all the codes and the corresponding errors of the system.

Moreover, considering that the problem of the system can occur while the user is riding a motorcycle, it is evident how the information provided by a blinking LED is not immediate and it does not allow the user to know exactly what is the problem and what he should carried out for trying to solve it. On the other hand, it is preferable that the device complexity is not increased to preserve the usability and the reliability of the inflatable protective device.

The object of the present invention is to provide a garment with an inflatable protective device, having a display unit which solves at least partly the above mentioned problems and drawbacks.

In particular, an aim of the present invention is to provide a garment with an inflatable protective device, having a display unit suitable for providing to the user not only information about the status of the inflatable protective device, but also able to indicate, in case of a problem, what kind of problem has been detected.

Moreover, an aim of the present invention is to provide a garment with an inflatable protective device, having a display unit suitable for suggesting to the user, in case of a problem, the actions to carry out.

A further aim of the present invention is to provide a garment with an inflatable protective device, having a display unit suitable for being easily integrated into the garment, without hindering the user's movement.

Another aim of the present invention is to provide a garment with an inflatable protective device, having a display unit suitable for being connected to the other components of the inflatable protective device, without requiring internal cabling inside the garment.

Finally, another aim of the present invention is to provide a garment with an inflatable protective device, having a display unit suitable for transmitting a user's command to the control unit of the inflatable protective device.

These and other objects and aims are achieved by the garment according to claim 1.

The advantages and the characteristic features of the invention will appear more clearly from the following description of a preferred, but not exclusive, embodiment of the garment with reference to the accompanying figures in which.

With reference to the attached figures, an example of a garment according to the invention is indicated as a whole by the reference 10. Said garment 10 is suitable for being used in particular by motorcycle riders. Nevertheless, as it will appear more clearly from the following description, the garment 10 can also be advantageously used by cyclists, skiers or in other fields where an effective protection of the user's body must be obtained.

Figure 2:
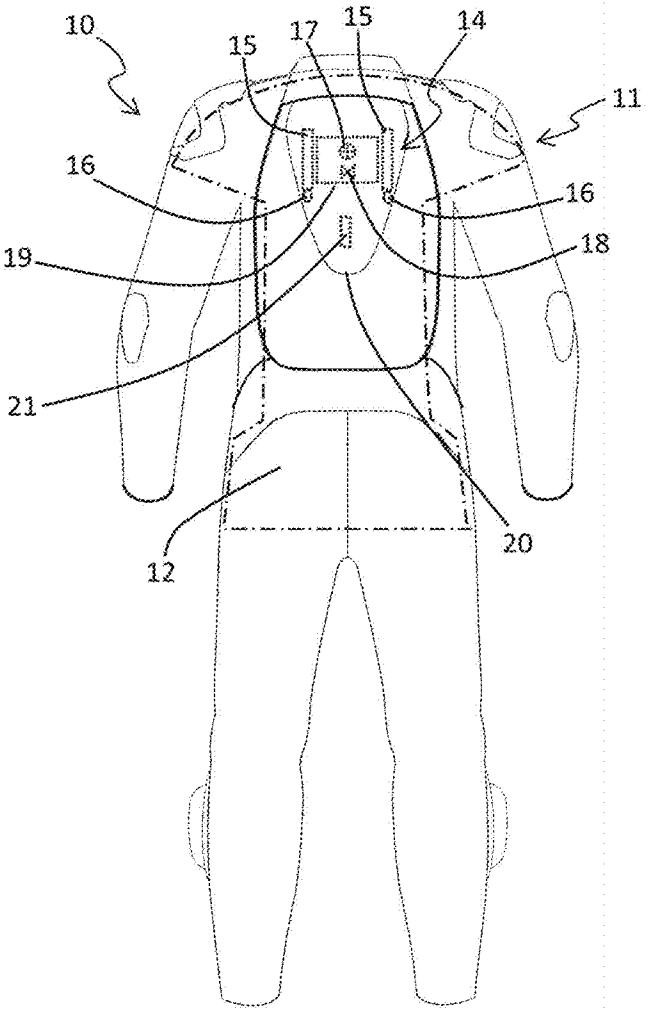
FIG. 2 shows a rear view of the garment of FIG. 1.
Figure 1:
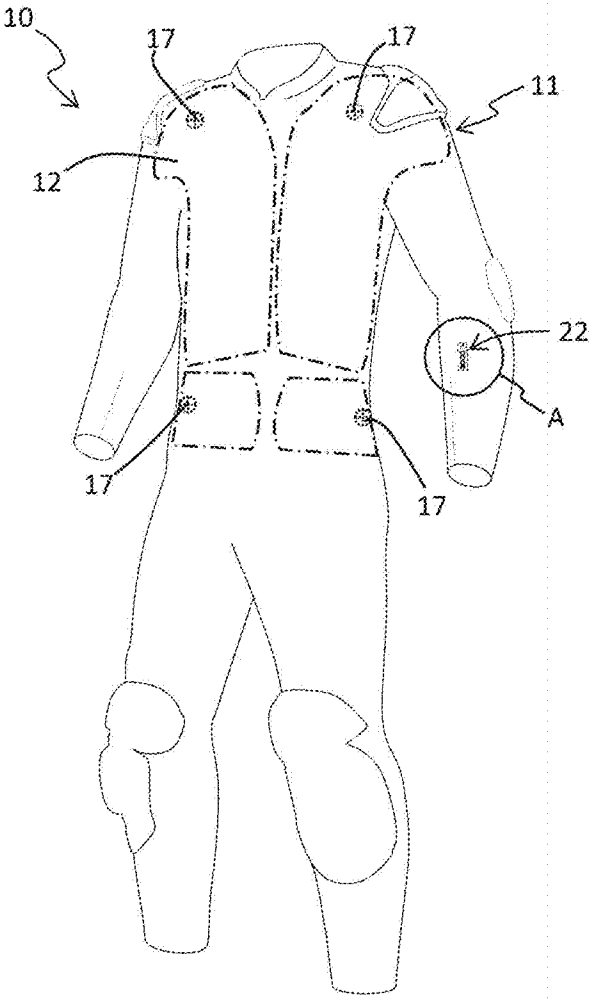
FIG. 1 shows a front view of a garment according to the present invention.
Figure 4:
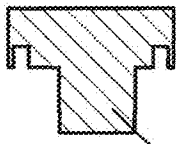
FIG. 4 shows a cross-sectional view taken along the line IV-IV of FIG. 3.
Figure 5:
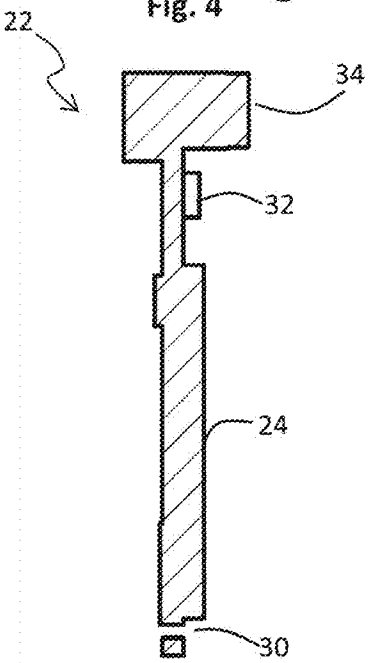
FIG. 5 shows a cross-sectional view taken along the line V-V of FIG. 3.
Figure 6:
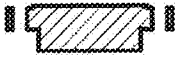
FIG. 6 shows a cross-sectional view taken along the line VI-VI of FIG. 3.

In FIGS. 1-2 a one-piece suit is shown. However, a garment according to the present invention can be manufactured as a jacket or a vest, preferably made with a material resistant to abrasion.

Alternatively, a garment according to the present invention can be manufactured as an undergarment (for example a vest), designed for being worn underneath an outer protective garment.

The garment 10 comprises an inflatable protective device 11.

The inflatable protective device 11 comprises at least one inflatable bag 12, suitable for moving between a rest condition, wherein it is deflated, and an operating condition, wherein it is inflated.

The inflatable bag 12 can be fixed to the inner surface of the garment 10. Alternatively, the inflatable bag 12 can be housed in a seat or in a pocket provided on the inner surface of the garment 10.

Alternatively, the inflatable bag 12 can be housed between the inner surface and the lining of the garment 10.

According to the embodiment of FIGS. 1 and 2, the garment 10 is provided with a single inflatable bag 12, designed for protecting the shoulders, the back, the flanks, the hips and the ribs of the user.

According to alternative embodiments of the invention, not shown in the attached drawings, the garment 10 may be provided with a plurality of inflatable bags, independent of each other and designed to be positioned opposite the portion of the body to be protected.

The inflatable protective device 11 also comprises an inflator unit 14 for the inflation of the inflatable bag 12.

According to the embodiment of FIGS. 1 and 2, the inflator unit 14 comprises two gas generators 15, preferably provided at the back portion of the garment 10.

Each gas generator 15 preferably comprises a gas generating material designed for being activated by a corresponding igniter 16 so as to generate a quantity of gas sufficient to inflate the inflatable bag 12.

Alternatively the inflator unit 14 can consist in a stored gas inflator designed for selectively releasing the pressurized gas stored therein for inflating the inflatable bag 12.

Alternatively, the inflator unit 14 can consist in a hybrid inflator unit which combines the use of a gas generating material and a quantity of stored pressurized gas to inflate the inflatable bag 12.

The inflatable protective device 11 also comprises sensors 17, 18 designed for monitoring the user's body for shocks or unexpected movements.

According to the embodiment of FIGS. 1 and 2, the garment 10 comprises six sensors 17, 18 preferably arranged at the shoulder area, at the hip area and at the back area. Preferably said sensors are accelerometers 17 or gyroscopes 18.

According to the embodiment of FIGS. 1 and 2 an accelerometer 17 and a gyroscope 18 are provided at the back portion of the garment 10.

Different arrangements and quantities of the sensors 17, 18 are possible in order to meet other specific needs.

In a further embodiment, not shown in the attached figures, the garment 10 can be provided with additional sensors designed for being preferably positioned in proximity of the user's body for detecting medical parameters of the user, like for example blood pressure, heart rate or blood oxygen level.

The inflatable protective device 11 also comprises a control unit 19. The control unit 19 is suitable for processing the data provided by the sensors 17, 18 in order to identify a danger situation.

If a danger situation is identified by the control unit 19, the latter sends an activation signal to the inflator unit 14 so as to inflate the inflatable bag 12.

According to the embodiment of FIGS. 1 and 2, when the control unit 19 detects that, on the basis of the data received by the sensors 17, 18, a danger situation is occurring, the control unit 19 provides ignition current to the igniter 16. Upon receipt of ignition current, the igniter 16 immediately ignites the gas generating material of the gas generator 15, causing the inflatable bag 12 to move from its rest condition to its operating condition.

As shown in the embodiment of FIGS. 1 and 2, the control unit 19 and the inflator unit 14 are preferably housed in a protection 20 arranged at the back portion of the garment 10. Preferably said protection 20 has an ergonomic and aerodynamic shape. One or more sensors 17, 18 can also be housed inside said protection 20.

Advantageously, inside the protection 20 also the battery 21 for supplying electric power to the various components of the inflatable protective device 11 might be housed.

In a further embodiment the control unit 19 and the inflator unit 14 may be integrated in a back protector of the user, eliminating in that case the need for the external protection element 20.

Preferably, the inflatable protective device 11 also comprises a memory card, for example a SD card, wherein the functioning data of the inflatable protective device 11 can be memorized for being analyzed later when the garment is not worn.

According to the invention, the garment 10 is also provided with a display unit 22 which comprises an alphanumeric and/or graphical visual display 24 for providing to the user messages and/or symbols about the internal status of the inflatable protective device 11.

According to the invention, the visual display 24 is suitable for providing an alphanumeric message.

Additionally or alternatively the visual display 24 is suitable for providing a message which can comprise symbols, images, icons or visual indicators.

In detail, the alphanumeric and/or graphical visual display 24 can be able to provide information about the status of each component of the inflatable protective device 11. For example, the alphanumeric and/or graphical visual display 24 is able to provide the user with visual information about the status of the sensors 17, 18, the inflator unit 14 and the control unit 19.

Moreover, the alphanumeric and/or graphical visual display 24 is also able to provide the user with visual information about the status of the battery 21 and about the battery charge level.

At the same time, if a failure is detected by the control unit 19 of the inflatable protective device 11, the alphanumeric and/or graphical visual display 24 is able to provide the user with information about the detected error and to suggest a possible action to perform for solving the problem.

Furthermore, as it will be explained in detail in the following, in case the garment 10 is provided with additional sensors suitable for detecting medical parameters, the alphanumeric and/or graphical visual display 24 can also be able to provide the user with these parameters.

Preferably the visual display 24 uses organic LED (OLED) technology, although any other appropriate display technology such as, for example, liquid crystal display (LCD) technology, light-emitting diode (LED) technology may be used.

Advantageously, the visual display 24 may provide visual information in monochrome or also in full color.

Preferably, the display unit 22 is integrated in the outer surface of the garment 10 as an active part thereof and not as a removable element.

In this way advantageously, once the garment 10 is worn by the user, the display unit 22 is ready for use.

In an alternative embodiment, the display unit 22 is removably fixed to the garment 10. In this way, it is made easier the replacement of the display unit 22 in case of need.

As it is shown in FIG. 1, preferably the display unit 22 is provided on the sleeve of the garment 10 (more preferably, on the forearm position), so as to be easily visible for the user, even when he is riding the motorcycle.

In FIGS. 3-9 a first embodiment of the display unit 22 according to the present invention is shown wherein the display unit 22 uses OLED technology.

Preferably, the display unit 22 comprises a PCB board 26, having shape and dimensions which can be varied according to the various needs.

The visual display 24 can be provided on the top surface of the PCB board 26 so as to be superimposed on it. For example, the visual display 24 can use OLED technology.

The visual display 24 can be connected to the PCB board 26 by means of a display connector 28 fixed to the bottom surface of the PCB board 26.

For reducing the overall length of the PCB board 26, advantageously the display connector 28, after having being inserted through a slit 30 provided in said PCB board 26, is wrapped at 90 degree around the PCB board 26.

The display unit 22 can be provided at the bottom surface of the PCB board 26 with a unit connector 23 by means of which the display unit 22 is connected to the control unit 19 of the inflatable protective device 11 for exchanging data between the display unit 22 and the control unit 19.

In a first embodiment the unit connector 23 is a connector to which a bidirectional cable connecting the control unit 19 and the display unit 22 can be connected.

Alternatively, the unit connector 23 can be a wireless connector through which the display unit 22 can be connected to the control unit 19 based on a wireless protocol, for example a Bluetooth standard.

In this way, advantageously no connecting cables between the control unit 19 and the display unit 22 should be provided inside the garment, making easier the positioning of the display unit 22 and assuring an optimum wearability of the garment.

Advantageously, the display unit 22 can comprise at least one signaling device 32, for example a LED light. Preferably, the signaling device 32 is provided on the top surface of the PCB board 26.

The function of said signaling device 32 is to supplement the messages and/or the symbols displayed on the visual display 24, for example by emitting a solid or a flashing light.

Moreover, advantageously the signaling device 32 can emit a flashing light with different speed of blinking.

Preferably, the signaling device 32 is autonomous from the visual display 24 even if it is combined, associated or integrated in the display unit 22.

In this way, in case of a fault of the visual display 24, the signaling device 32 can still operate, offering an improved level of safety.

For example, the signaling device 32 can provide the user with basic information even in case the visual display 24 is damaged. For example, the signaling device 32 can be designed to emit a specific light or sound to inform the user that a fault of the protective device 11 or/and of the visual display 24 is occurred.

According to the embodiment shown in the attached figures, preferably the signaling device 32 consists of three signaling lights 32.

Preferably, said signaling lights 32 have different colors, for example green, red and yellow so as to provide, in combination with the visual display 24, different information to the user.

According to an alternative embodiment, the signaling device 32 can be integrated in the background lighting of the visual display 24. In particular, the signaling device 32 can comprise one or more lights designed to be positioned adjacent the visual display 24 so as to change the background of the visual display 24. For example, said lights might be positioned under or at the side of the visual display. These lights might be also embodied as a light path.

For example, the background lighting of the visual display 24 can be changed according to the information to be provided to the user.

For providing warning information the signaling device 32 can be designed to change in red the background of the visual display 24. Similarly, for providing alert information the signaling device 32 can be designed to change in yellow the background of the visual display 24.

In this way the signaling device 32 can draw the user's attention on the messages and/or symbols displayed on the visual display 24.

Figure 3:
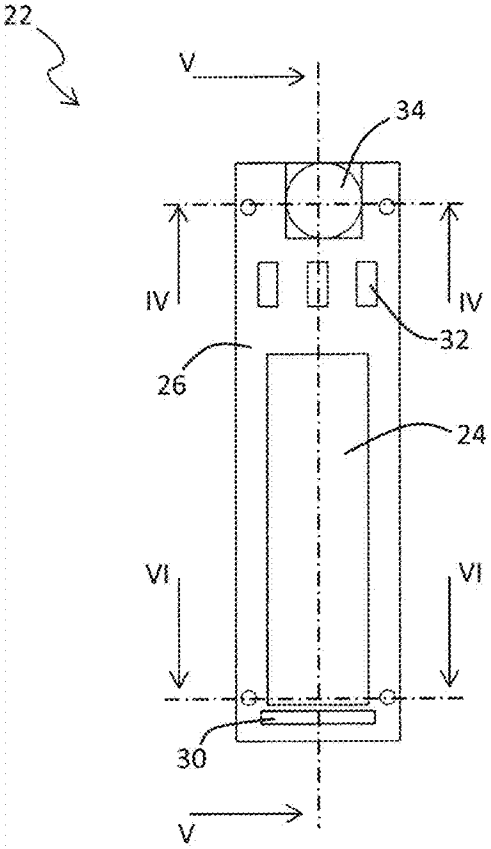
FIG. 3 shows an enlarged view of the detail A of FIG. 1.
Figure 7:
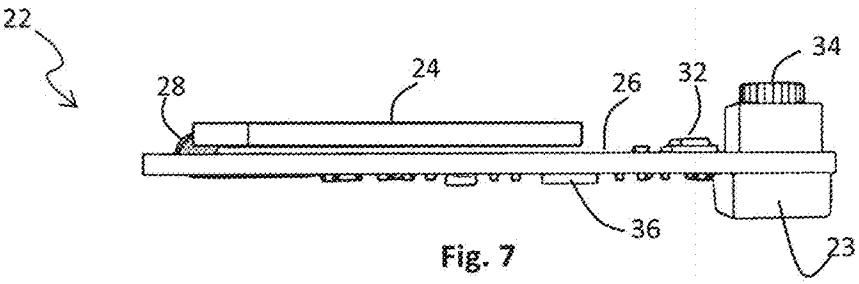
FIG. 7 shows a side view of a first embodiment of the display unit of a garment according to the present invention.
Figure 8:
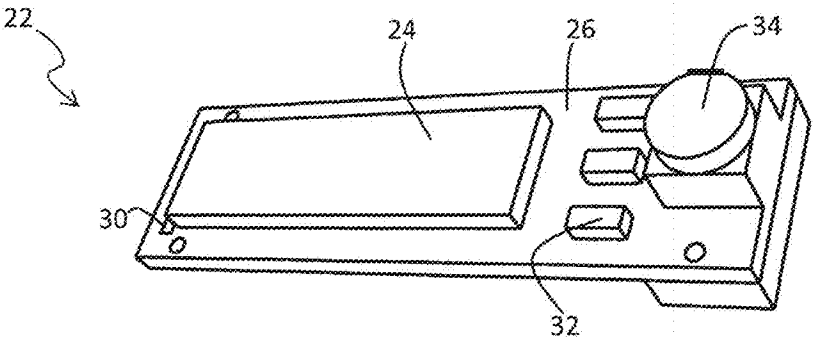
FIG. 8 shows a front perspective view of the display unit of FIG. 7.

According to the embodiment of FIG. 3, the display unit 22 can also comprise a user interface 34 to input commands. Preferably said user interface is a button provided on the top surface of the PCB board 26.

As it will be described in detail in the following, by means of said interface 34 the user is able to switch on/off the display unit 22. In a further embodiment, by means of said interface 34 the user is also able to enable/disable the activation of the inflator unit 14, for example in case the user is not riding the motorcycle.

According to one embodiment of the present invention, by pressing the user interface 34 for a first prefixed long duration (for example at least 3 seconds), the display unit 22 can be switched on or off.

Similarly, by pressing the user interface 34 for a second prefixed long duration (for example at least 5 seconds), the activation of the inflator unit 14 can be enabled or disabled.

Figure 8A:
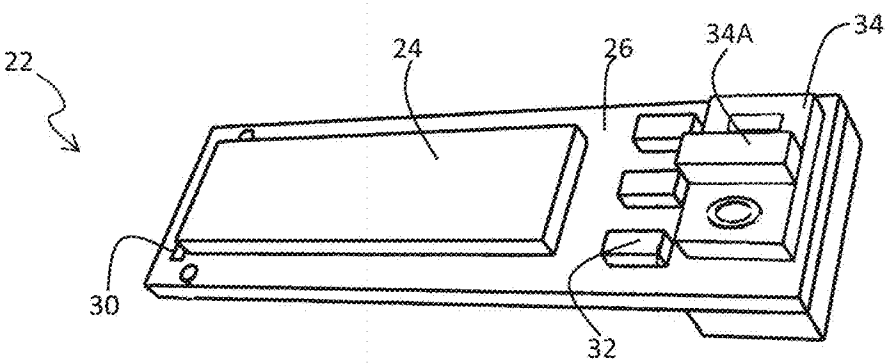
FIG. 8A shows a front perspective view, similar to that of FIG. 8, of a second embodiment of the display unit of the garment according to the present invention.

According to the embodiment of FIG. 8A, the user interface consists in a slide switch 34 that uses a movable slider 34A, movable from an open position to a closed position and viceversa, so as to switch off/switch on the visual display 24.

Additionally, as previously disclosed with reference to the embodiment of FIG. 3, the slide switch 34 can also be able to enable/disable the activation of the inflator unit 14.

Preferably, the movable slider 34A of the slide switch can also act as a button so as to allow the user to input different commands or to slide between the messages and/or symbols displayed on the visual display 24.

According to the embodiment of FIGS. 3-9, the display unit 22 also comprises a microprocessor 36.

The function of the microprocessor 36 is to control which messages and/or symbols are to be displayed on the visual display 24 on the basis of data sent to the display unit 22 by the control unit 19. At the same time, the function of the microprocessor 36 is to command the signaling device 32 on the basis of the data received from the control unit 19 and/or on the basis of the messages displayed on the visual display 24.

As it is well known in the art, the microprocessor 36 can comprise a memory area wherein the messages and/or symbols to be displayed on the visual display 24 are memorized. Moreover, the microprocessor 36 can be provided with an additional memory wherein personal information of the garment's user might be memorized, such as for example the blood group, the emergency contact, cardiac problems, allergies, etc. For example, the microprocessor 36 might be programmed for displaying such type of personal information on the visual display 24 once the inflatable bag 12 of the inflatable protective device 11 has been deployed, as a means of information for first aid and medical interventions.

Furthermore, the microprocessor 36 can comprises a control system for decoding data received from the control unit 19 about the internal status of the inflatable protective device 11. Preferably, the status of the inflatable protective device 11 is encoded in a status word. This status word can be managed with a different number of bits. For example, a prefixed number of bits of the word can code the status of the sensor, the status of the inflator unit, the status of the battery, etc.

All the status bits can be combined in the status word and sent to the microprocessor 36 of the display unit 22.

The microprocessor 36 is also advantageously provided with a decoding system for decoding the inputs provided by the user by means of the user interface 34.

Figure 9:
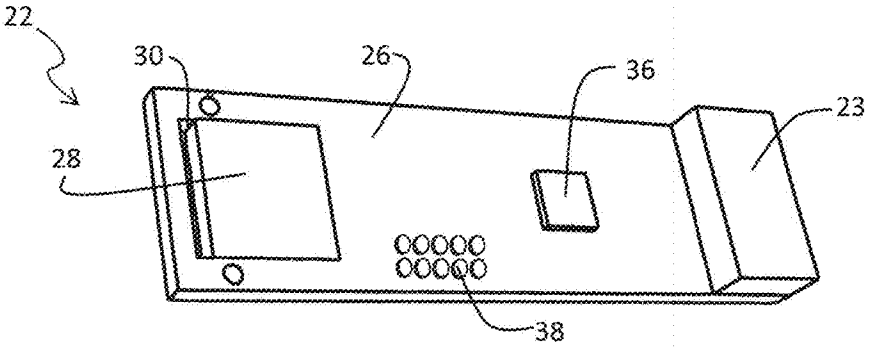
FIG. 9 shows a rear perspective view of the display unit of FIG. 7.

With reference to FIG. 9, the display unit 22 can be also provided with a programming interface 38 provided on the bottom side of the PCB board 36.

Figure 10:
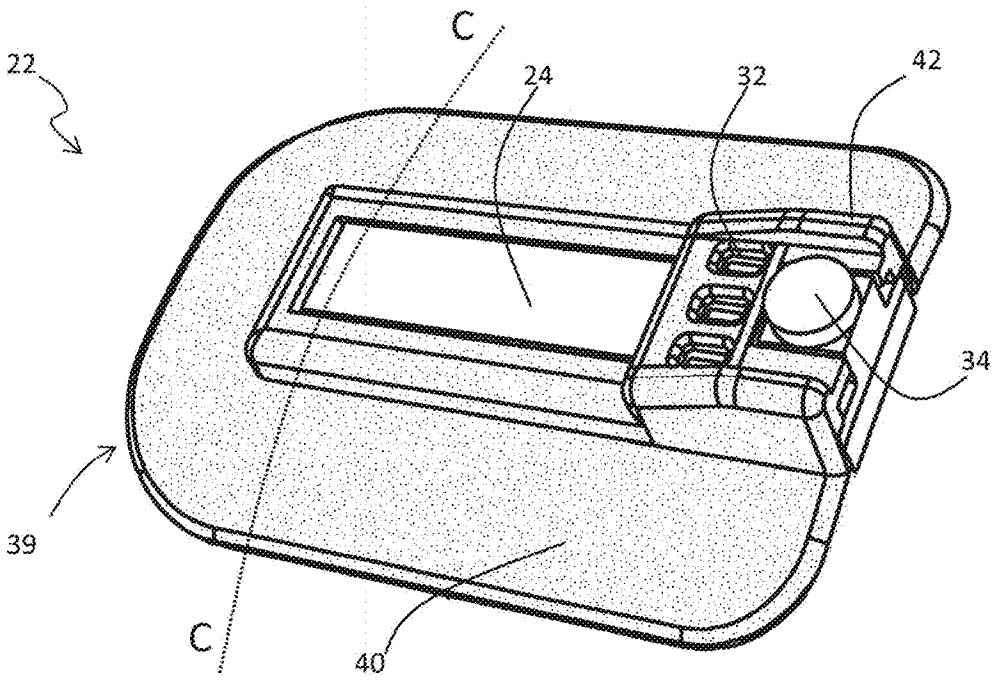
FIG. 10 shows a front perspective view of a third embodiment of the display unit of a garment according to the present invention.

According to the embodiment of FIG. 10, the display unit 22 can comprise a fastening margin 40. Said fastening margin 40 is preferably made with a polymeric material and it can surround the PCB board 26 of the display unit 22.

The function of the fastening margin 40 is to make easier the fastening of the display unit 22 to the garment 10 for example by means of seams or by means of adhesive. The fastening margin 40 is designed for being positioned hidden from view underneath the outer surface of the garment 10, so as to leave exposed the visual display 24, the user interface 34 and the signaling device 32, if present.

As it is shown in FIG. 10, advantageously the fastening margin 40 might be provided with an ergonomic curvature C so as to allow the display unit 22 to match the curvature of the surface of the garment to which the display unit 22 is fastened.

Preferably, protection walls 42 surrounding the signaling device 32 and the user interface 34 can extend from the fastening margin 40.

Said protection walls 42 have the function to protect the signaling device 32 and the user interface 34 against shocks and/or abrasion.

In other words, as it is shown in FIG. 10, the display unit 22 can be inserted in a protective housing 39 which comprises the fastening margin 40 and the protection wall 42.

Advantageously, the display unit 22 is removably housed inside the protective housing 39 comprising the fastening margin 40 and the protection walls 42. The protective housing 39 can be fixed to the garment along the fastening margin 40, for example by means of stitching.

Therefore, the display unit 22 can be detached from the garment 10, even if the protective housing 39 is integral with the garment.

In this way, an easy replacement of the display unit 22 is allowed. This is particularly useful in case of a fault or in case the display unit 22 should be changed with an updated version or model.

Preferably, the display unit 22 can be removably fixed inside the protective housing 39 by means of snap-fit fixing means.

In detail the display unit 22 can be inserted inside the protective housing 39 by inserting it in a seat, properly shaped, arranged in the protective housing.

To remove the display unit 22 from the protective housing 39 it will be enough to pull out the display unit 22 and, in case the display unit 22 is connected to the control unit 19 by a bidirectional cable, to detach the cable.

The display unit 22 shown in FIG. 8A can also be fixed to the garment by means of a protective housing 39 like that of FIG. 10.

Figure 11:
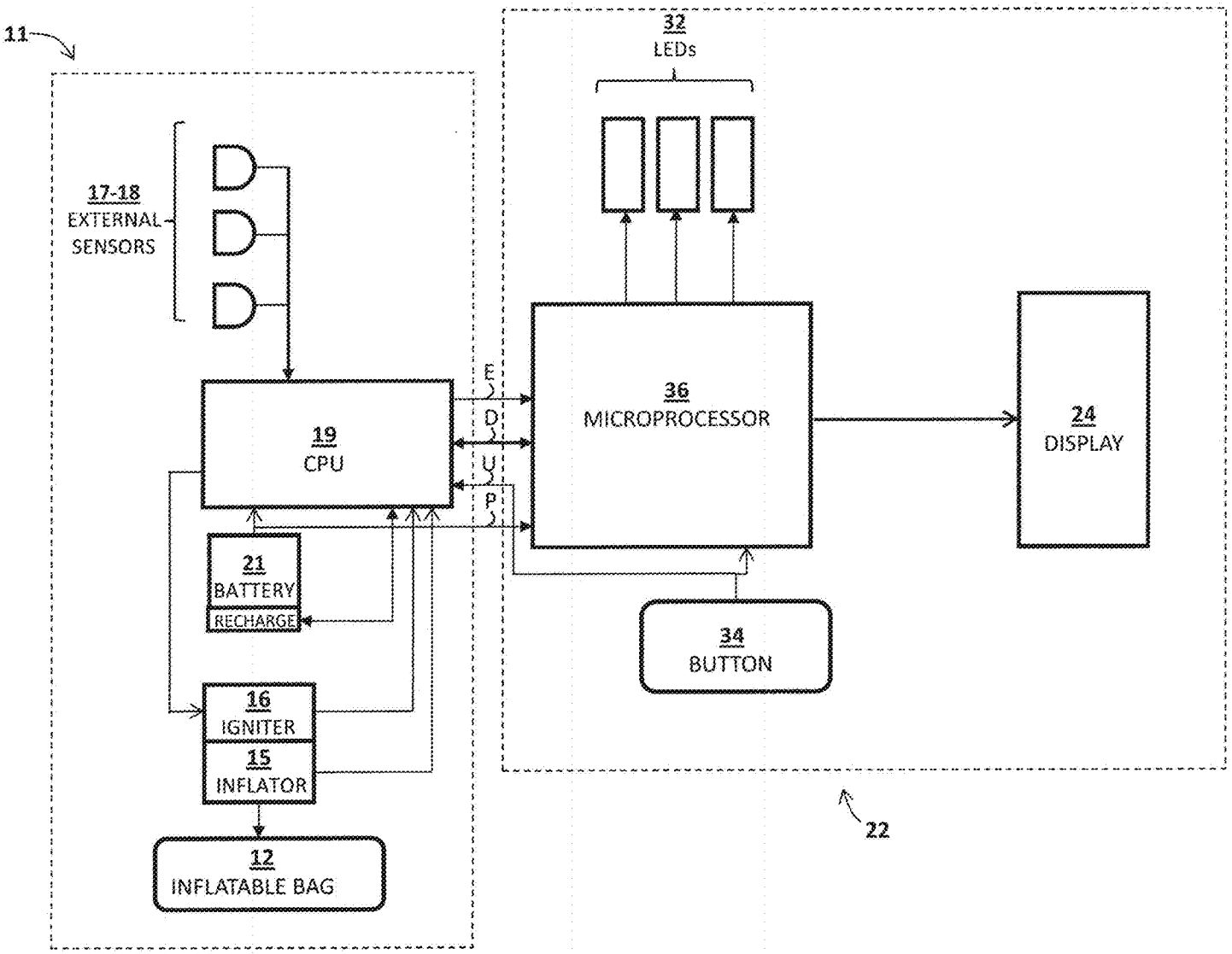
FIG. 11 shows a schematic block diagram of the inflatable protective device and the display unit of a garment according to the present invention.

In FIG. 11, a schematic block diagram of the inflatable protective device 11 and the display unit 22 of a garment 10 according to the present invention is shown.

The inflatable protective device 11 and the display unit 22 have been schematically represented by two blocks, each encircled by dot lines.

The two blocks are connected to each other by communication lines, for example preferably by three data lines.

By means of the first data line E the control unit 19 transmits to the microprocessor 36 of the display unit 22 a signal for enabling the visual display 24. In this way, the control unit 19 can activate for example the visualization of messages and warning signals on the display unit 22 and/or deactivate the display unit 22 so that even if the user acts on the user interface 34, the display unit 22 cannot be switched on.

By means of the second data line D, which is bidirectional, the control unit 19 and the microprocessor 36 exchange data about the status of the inflatable protective device 11 and about the information and/or diagnostic message displayed on the visual display 24. For example, the data line D can comprise two serial communication lines, one to send data from display unit 22 to the control unit 19 and the other one to send data (for example the serialization of the status word) from the control unit 19 to display unit 22.

As it is shown in FIG. 11, the status data received by the external sensors 17, 18, the level of battery charge, the status data of the igniter 16 and of the inflator 15 are received by the control unit (CPU) 19 for being transmitted to the microprocessor 36 through the data line D.

According to the data received by the control unit 19, the microprocessor 36 will display a corresponding alphanumeric and/or graphical message on the visual display 24. At the same time, if the display unit 22 is provided with a signaling device 32, the microprocessor 36 can command the switching on of the LED lights.

The microprocessor 36 can decide which messages and lights have to be activated depending of data that the microprocessor 36 receives via the data line D.

The third data line U is dedicated for sending to the control unit 19 a signal when the user interface 34 is activated by the user so that the control unit 19 receives the signal even if the display unit 22 is switched off. The user's inputs are transmitted both to the control unit 19 and the microprocessor 36.

As anticipated, by acting on the interface 34 the user can command the switching on/off of the display unit 22.

Similarly, by acting on the interface 34 the user can enable/disable the activation of the inflator unit 14.

An electric power line P (usually by means of two electric wires) can be provided to send electric power to the display unit 22 by the battery 21 of the inflatable protective device 11.

Different arrangements of the data lines between the inflatable protective device 11 and the display unit 22 are possible in order to meet different needs. The display unit 22 can be connected to the control unit 19 via data communication lines which can be carried out in several ways (for example serial or parallel communication lines, wired or wireless).

Figure 11A:
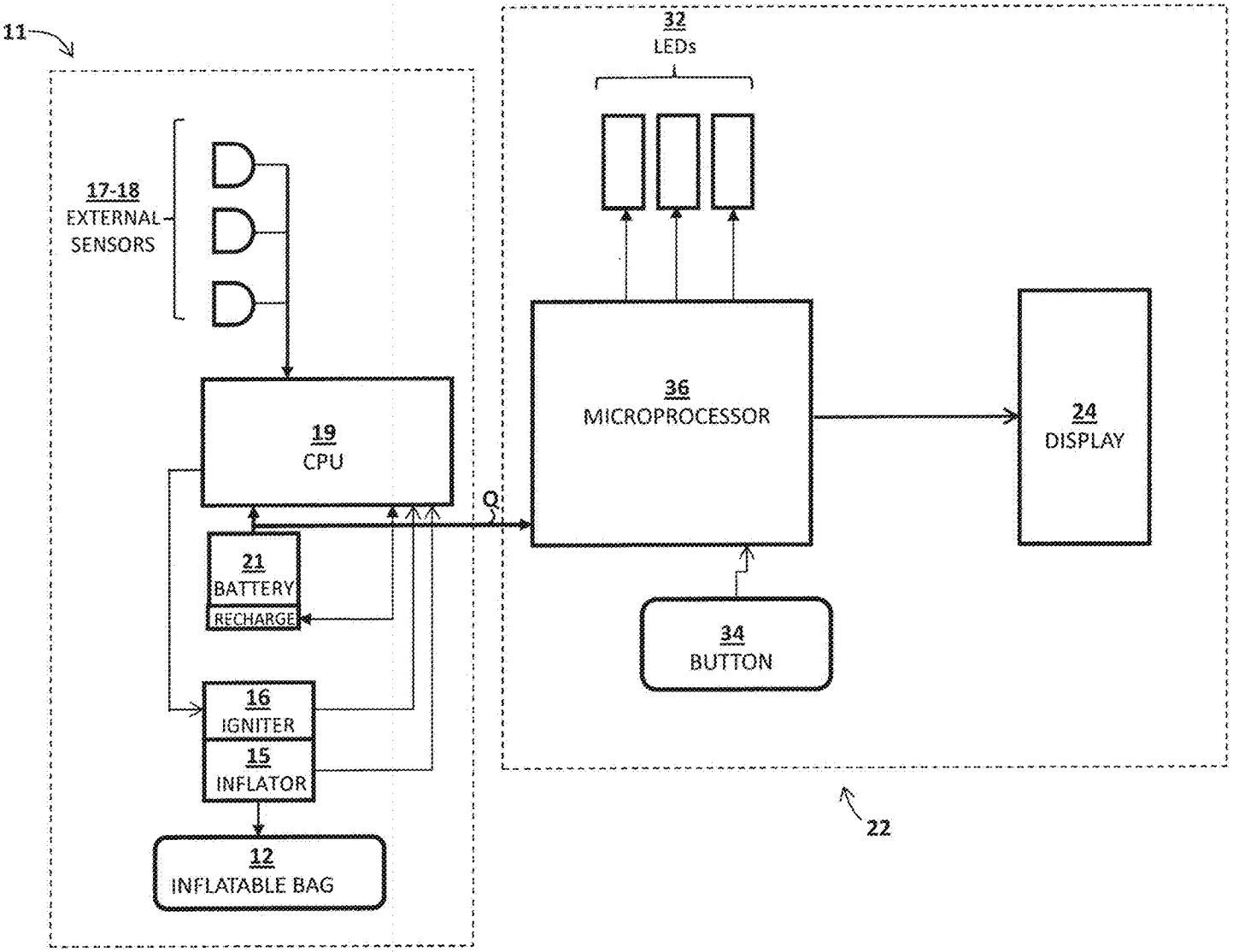
FIG. 11A shows a schematic block diagram, similar of that of FIG. 11, relating to a different embodiment of the present invention.

In FIG. 11A, a different way to connect the inflatable protective device 11 and the display unit 22 of the garment 10 is shown.

In particular, the inflatable protective device 11 and the display unit 22, which are both schematically represented by a block encircled by a dot line, can be connected by a single line Q for the transmission of data and of power between the control unit 19 and the microprocessor 36.

In detail, by means of this single line Q the battery 21 is connected to the microprocessor 36 and the control unit 19. Advantageously, the single line Q can comprise two wires accommodated inside a single cable. This considerably reduces the cost of the line.

The transmission of data and power can be carried out adapting well known standard serial power-line communication protocols, like X10 or UPB, and preserving the possibility to put all the system in a stand-by low consumption mode, waking up the control unit 19 by an appropriate hardware interface.

Figure 12:
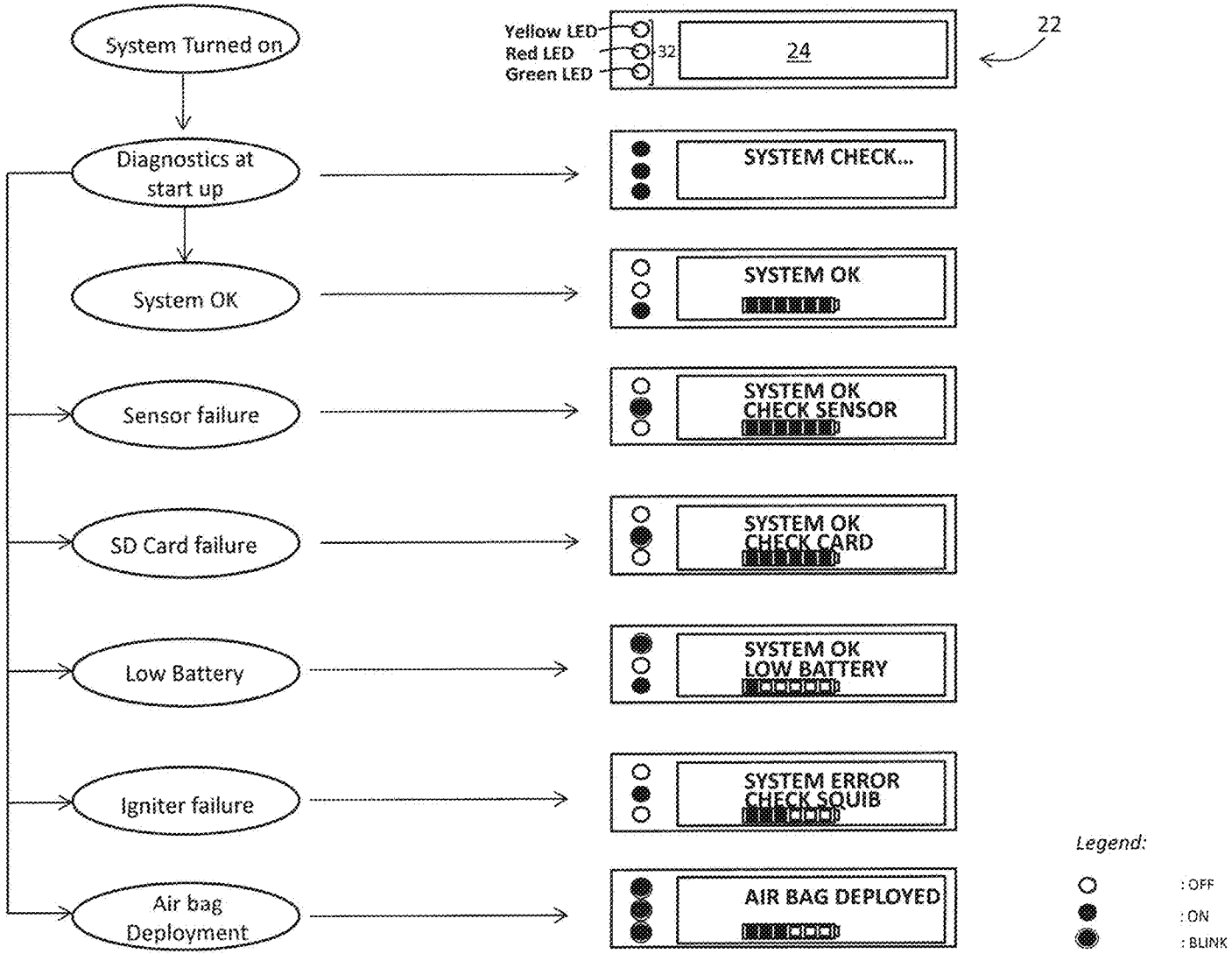
FIG. 12 shows schematically some examples of the information that can be displayed on the display of the display unit of the garment according to the present invention.

In FIG. 12 some examples of the information/messages which can be displayed on the visual display 24 and by means of the signaling LEDs 32 are provided.

When the inflatable protective device 11 is turned on, a diagnostic check can be initialized. During such a check, which can have duration of about ten seconds, the control unit 19 of the inflatable protective device 11 performs a control of the various components of the inflatable protective device for verifying their status and sends the status word to the display unit 22.

During the check the message "System check . . . " is displayed on the visual display 24. At the same time, all the LEDs are illuminated with a solid light.

If, after the diagnostic check, all the components of the inflatable protective device 11 function properly the status word received by the display unit 22 corresponds to the system completely operative and the message "System OK" is displayed on the visual display 24 by the microprocessor 36. At the same time, only the green LED is illuminated with a solid light.

The "System OK" message signals to the user that the inflatable protective device 11 is armed, namely that in case of a danger it is able to be deployed.

The message "System OK" will be displayed preferably on the visual display 24 even if a minor failure, which does not prevent the functioning of the inflatable protective device, is detected.

If, a failure is detected by the control unit 19 after the diagnostic check, the status word received by the display unit 22 corresponds to the system not completely operative and various messages can be displayed on the visual display 24 according to the different failure which has been detected.

For example, in case a sensor 17, 18 failure is detected, the message "System OK—Check sensor" will be displayed on the visual display 24. Moreover, the red LED can be illuminated with a flashing light.

For example, a sensor failure might occur when one (or more) sensor 17, 18 became disconnect or suffers a failure.

Advantageously, in this case the inflatable protective device 11 is still functioning, since the control unit 19 is able to adapt to the missing sensor.

In case a SD card failure is detected, the message "System OK—Check card" will be displayed on the visual display 24. Moreover, the red LED can be illuminated with a flashing light.

Such type of failure can be detected when the SD card is not inserted inside its slot or it is not formatted properly. Also in this case the inflatable protective device 11 is armed. However, the functioning data of the inflatable protective device 11 cannot be memorized for being analyzed later, if needed.

In case a low battery level is detected, the message "System OK—Low battery" will be displayed on the visual display 24. Moreover, the green LED can be illuminated with a solid light, while the yellow LED can be illuminated with a flashing light.

This failure is detected when the battery level is getting low.

The message "System error—Check squib" will be displayed on the visual display 24 in case an igniter failure is detected. Moreover, the red LED can be illuminated with a solid light. In this case, the inflatable protective device 11 is not armed and the inflatable bag 12 cannot be inflated.

Such type of error can occur when the control unit 19 cannot detect the presence of a gas generator 15 or when a failure is detect in the activation circuit of the igniter 16.

Finally, in case the inflatable bag 12 is deployed, the message "Airbag deployed" will be displayed on the visual display 24. In this case, all the LEDs will be illuminated with a flashing light.

The above combinations are described by way of example, without limitation about the messages and LED indications which can be displayed by means of the display unit 22 within the scope of the disclosure.

At this point it is clear how the predefined objects may be achieved with the garment 10 according to the invention.

As a matter of fact, the display unit 22 of the garment is able to provide immediate information about the internal status of the inflatable protective device 11 and at the same time it is able to suggest to the user some actions to do for overcoming a possible failure.

Moreover, by means of the user interface 34 of the display unit 22 the user is able to interact with the control unit 19 of the inflatable protective device 11 so as to set the functioning of the inflatable protective device according to his specific needs.

Furthermore, the ergonomic shape of the display unit 22 allows the latter to be easily integrated into the garment without affecting the wearability thereof.

With the preferable structure disclosed above, the connection lines between the control unit and the display unit can be reduced in number. Moreover, by using a status word which is sent from the control unit to the display unit it is possible to change type, language, words of the messages without changing the control unit and the inflatable protective device 11, but only changing or reprogramming the display unit.

Finally, the protection walls 42 assure an optimum protection to the various components of the display unit 22 against shocks and abrasion, reducing the risk that the display unit 22 might be damaged.

With regard to the embodiments of the garment 10 described above, the person skilled in the art may, in order to satisfy specific requirements, make modifications to and/or replace elements described with equivalent elements, without thereby departing from the scope of the accompanying claims.

The invention claimed is:

1. A garment comprising an inflatable protective device, the inflatable protective device comprising:

at least one inflatable bag suitable for moving between a rest condition; wherein it is deflated, and an operating condition, wherein it is inflated;

an inflator unit designed for inflating the at least one inflatable bag;

sensors designed for monitoring the user's body for shocks or unexpected movements;

a control unit designed for processing the data provided by the sensors and for activating the inflator unit if, on the basis of the data received by the sensors, a danger situation is identified;

wherein the garment is provided with a display unit which comprises an alphanumeric and/or graphical visual display for providing the user with messages and/or symbols about the internal status of the inflatable protective device, wherein mode of communication between the display unit and the control unit is wireless; and wherein the display unit comprises at least one signaling device for supplementing the messages and/or symbols displayed on the alphanumeric and/or graphical visual display.

2. The garment according to claim 1, characterized in that the display unit is integrated in an outer surface of the garment.

3. The garment according to claim 1, characterized in that the display unit comprises a user interface;

by acting on said user interface the user being able to switch on/off the display unit and/or to enable/disable the activation of the inflator unit.

4. The garment according to claim 1, characterized in that the display unit comprises a microprocessor designed for controlling which messages and/or symbols are to be displayed on the alphanumeric and/or graphical visual display on the basis of data sent to the display unit by the control unit.

5. The garment according to claim 4, characterized in that the data sent to the display unit comprise a status word representing the internal status of the inflatable protective device.

6. The garment according to claim 1, characterized in that the display unit comprises a microprocessor designed for commanding the signaling device on the basis of data received from the control unit.

7. The garment according to claim 1, characterized in that the display unit comprises a microprocessor comprising at least a memory area, wherein the messages and/or symbols to be displayed on the alphanumeric and/or graphical visual display are memorized, and a control system, for decoding data received from the control unit about the internal status of the inflatable protective device.

8. The garment according to claim 1, characterized in that the inflatable protective device and the display unit are connected to each other by means of an electric power line allowing the supply of electric power to the display unit by means of a battery of the inflatable protective device.

9. The garment according to claim 1, characterized in that the display unit comprises a microprocessor comprising at least a decoding system, for decoding the inputs provided by the user by means of a user interface.

10. The garment according to claim 1, characterized in that the alphanumeric and/or graphical visual display uses organic LED technology or liquid crystal display (LCD) technology or light-emitting diode (LED) technology.

11. The garment according to claim 1, characterized in that the display unit comprises a fastening margin having an ergonomic curvature matching the curvature of the surface of the garment to which the display unit is fastened.

12. The garment according to claim 7, characterized in that the microprocessor comprises an additional memory wherein personal information of the user are memorized.

13. The garment according to claim 12, characterized in that the microprocessor is programmed for displaying on the alphanumeric and/or graphical visual display the personal information of the user memorized in said additional memory once the at least one inflatable bag of the inflatable protective device has been deployed.

14. The garment according to claim 1, characterized in that said at least one signaling device is integrated in the background lighting of the visual display;

said at least one signaling device comprising one or more lights designed to be positioned adjacent the visual display.

15. The garment according to claim 1, characterized in that said at least one signaling device is autonomous from the visual display;

said at east one signaling device being integrated in the display unit.

16. The garment according to claim 1, wherein the signaling device can provide the user with basic information without the visual display being fully functional.

17. The garment according to claim 1, wherein the signaling device is configured to provide a signal for informing user of a fault of the protective device and/or the visual display.

18. The garment according to claim 17, wherein the signal is a light being emitted from the display device.

19. The garment according to claim 17, wherein the signal is a sound being created from the display device.

* * * * *